US005529005A

United States Patent [19]

Saotome et al.

[11] Patent Number: 5,529,005

[45] Date of Patent: Jun. 25, 1996

[54] TOWEL CLOTH DRAWING-OUT DEVICE

[75] Inventors: Kenichi Saotome; Yuji Ohoshima, both of Utsunomiya, Japan

[73] Assignee: The Singer Company N.V., Curaco, Netherlands Antilles

[21] Appl. No.: 281,059

[22] Filed: Jul. 27, 1994

[30] Foreign Application Priority Data

Sep. 10, 1993 [JP] Japan ..... 5-248485

[51] Int. Cl.[6] ..... D05B 27/00; B26D 5/42

[52] U.S. Cl. ..... 112/470.31; 112/305; 112/129; 83/18

[58] Field of Search ..... 112/470.06, 470.31, 112/130, 307, 303, 305, 311; 83/18, 56, 61, 63, 175; 271/42, 226, 227; 26/7; 28/160, 170

[56] References Cited

U.S. PATENT DOCUMENTS 4,375,175 3/1983 Elsas et al. ..... 83/18
4,607,582 8/1986 Brocklehurst ..... 112/470.06
4,962,712 10/1990 Sotome et al. ..... 112/305
5,033,341 7/1991 Müssig et al. ..... 83/18
5,299,513 4/1994 Kambara et al. ..... 112/121.26

*Primary Examiner*—Ismael Izaguirre
*Attorney, Agent, or Firm*—McCormick, Paulding & Huber

[57] ABSTRACT

A towel cloth drawing-out device comprises a pair of working tables facing each other with a gap therebetween, a towel cloth drawing unit for drawing out the towel cloth from the towel material to hang the same in the gap, a towel cloth clamp member which is provided in the gap and is able to reciprocate in the drawing direction of the towel cloth, a driving unit for reciprocating the towel cloth clamp member and a vertical wall which is provided on the side of one of the working tables, the working table being disposed on the drawing side of the towel cloth, for clamping the same between the towel cloth clamp member and itself. As a result, it is possible to automatically continue the cutting operation of towel cloth by successively drawing out the towel material without substantially stopping the cutting operation even if the towel material has a weave error in the length of uniformly woven portions therein since it can be drawn out long enough to be easily found and removed later so that it is possible to remarkably improve productivity and operability in a towel sewing factory.

1 Claim, 6 Drawing Sheets

TOWEL CLOTH DRAWING-OUT DEVICE

BACKGROUND OF THE INVENTION

1. Field of the Invention

The present invention relates to a towel cloth drawing-out device.

2. Description and Problems of the Related Art

In a towel sewing factory, a given length of towel cloth is drawn out onto a work table equipped with a cutting device from a towel material of long size alternately and continuously composed of pile fabric portions and plain woven portions by way of various methods to cut off a piece of towel cloth therefrom by cutting the towel material at the plain woven portion thereof for sewing.

Such a conventional automatic towel sewing machine which draws out and cut off a towel cloth from a towel material is disclosed, for example, in the Japanese Utility Model Laid-Open Publication No.2-392. That is, the towel cloth is drawn out from a towel material by a clamping device onto a pair of work tables facing each other with a gap therebetween, then a towel cloth pushing down re ember is lowered from above the gap to draw out the towel cloth by a given length from the towel material and. thereafter a thickness detector is operated to stop the towel cloth at the pile fabric portion thereof so as to cut off a piece of towel from the towel material by a cutting device.

Such a conventional towel cloth drawing-out-device, however, works normally only for a towel material regularly and alternately composed of pile fabric portions and plain woven portions having given lengths respectively. As a result, there is an inconvenience of being unable to draw out the towel cloth as long as a length more than that determined by the stroke of the towel pushing down member from a towel material having a weave error in the length of the pile fabric or plain woven portions thereof or having joints therein even if the drawing amount of the towel cloth should be increased temporarily. On the other hand, in case the stroke of the towel cloth pushing down member is increased to deal with the problem, the towel cloth drawing-out device becomes large in scale.

SUMMARY OF THE INVENTION

The present invention has been-made from a viewpoint of such a conventional technical problem to provide a towel cloth drawing-out device for intermittently drawing out a towel cloth A substantially as long as a piece of towel from a towel material B of long size alternately and continuously composed of pile fabric portions A1 and plain woven portions A2 and thereafter aligning the line of demarcation AL between the pile fabric portion A1 and the plain woven portion A2 to cut the towel material B at the plain woven portion thereof characterized in that the drawing-out device comprises a pair of a first working table 2*a* and a second working table 2*b* facing each other with a gap 2*c* therebetween, a towel cloth drawing unit 6 for drawing out the towel cloth A from the towel material B to hang the same in the gap 2*c*, a towel cloth clamp member 12 which is provided in the gap 2*c* and is able to reciprocate in the drawing direction of the towel cloth A, a driving unit 14 for reciprocating the towel cloth clamp member 12 and a vertical wall 2*d* which is provided on the side of the second working table 2*b* disposed on the drawing side of the towel cloth A for clamping the same between the towel cloth clamp member 12 and itself.

When the towel cloth A as long as a piece of towel is cut off from the towel material B of long size alternately and continuously composed of pile fabric portions A1 and plain woven portions A2, the towel cloth drawing unit 6 draws out the towel cloth A from the towel material B to hang the same in the gap 2*c*. If the length of the towel cloth drawn out by the drawing unit 6 is improper, the towel cloth clamp member 12 is driven. It occurs, for example, in case the towel material has a weave error in the length of the pile fabric portion A1 or plain woven portion A2, or has joints therein.

In such a case, the driving unit 14 drives the towel cloth clamp member 12 to push the towel cloth A which hangs in the gap 2*c* in the drawing direction of the towel cloth A to thereby clamp the same between the vertical wall 2*d* provided on the side of the vertical wall 2*d* and itself At this state, the towel cloth drawing unit 6 draws out again the towel cloth A from the towel material B to hang the same in the gap 2*c* so as to draw out the same substantially as long as two pieces of towel cloth to cut the towel cloth A at the next plain woven portion thereof.

DESCRIPTION OF THE PREFERRED EMBODIMENT

An embodiment of the present invention will be described with reference to drawings hereinafter.

Figure 2:
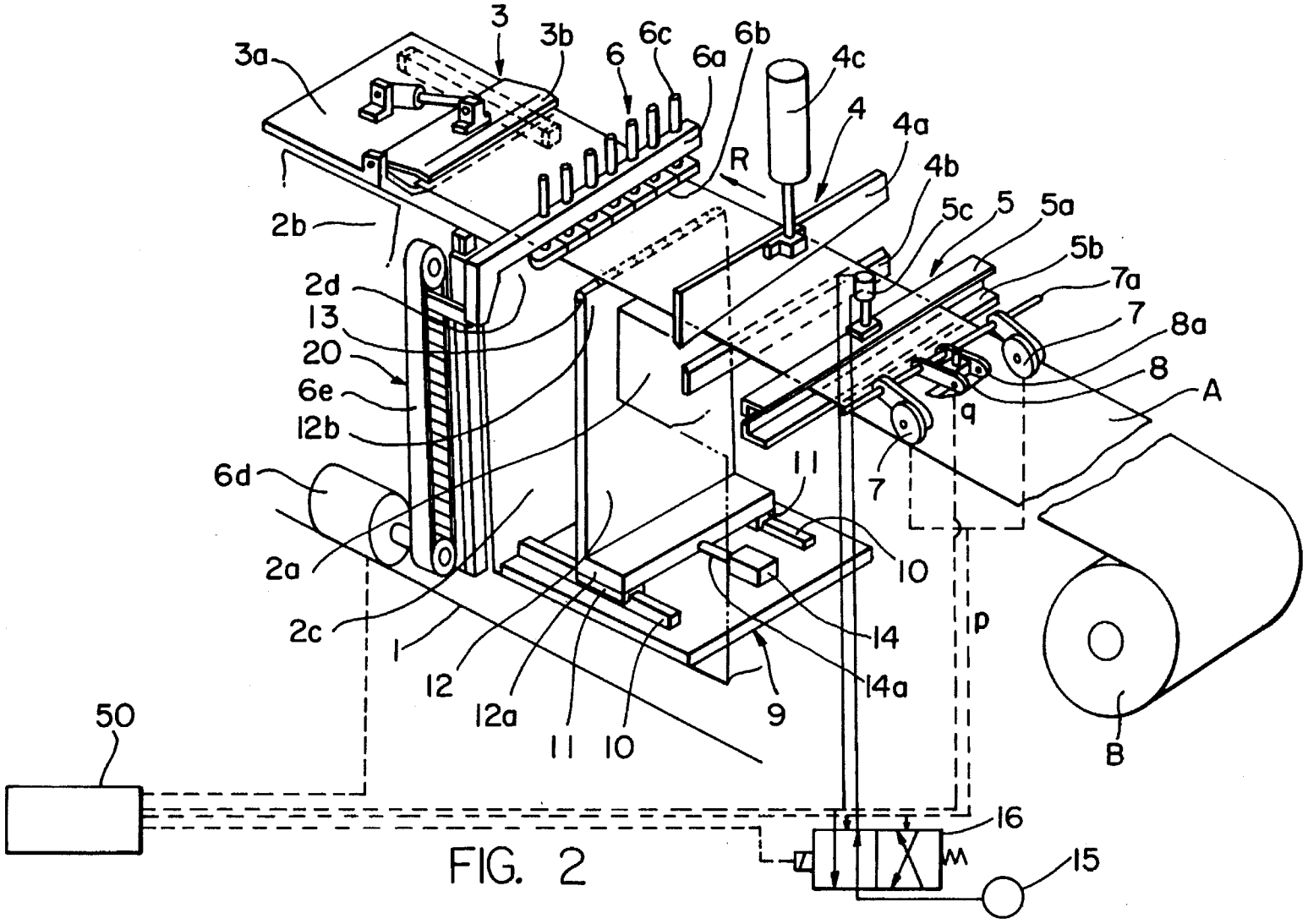
FIG. 2 is a perspective view showing the towel cloth drawing-out device in FIG. 1.
Figure 3:
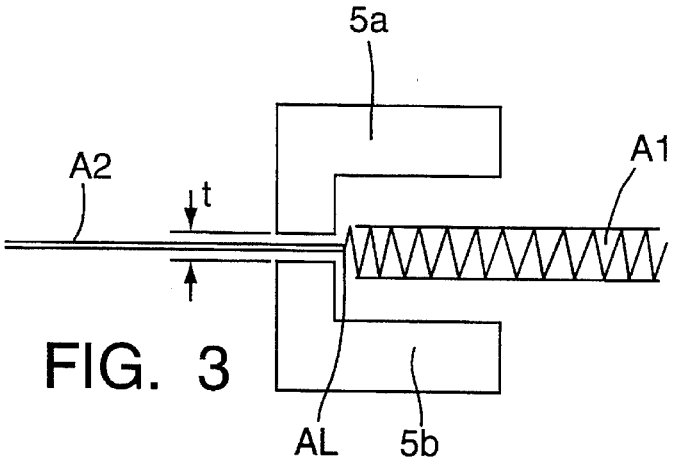
FIG. 3 is view showing a thickness detector in FIG. 1.
Figure 4:
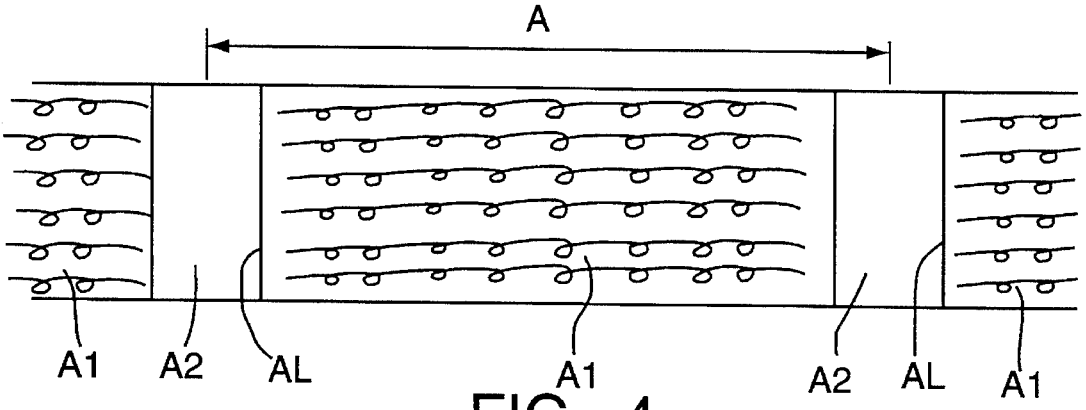
FIG. 4 is a plan view of a towel material in FIG. 1.
Figure 5:
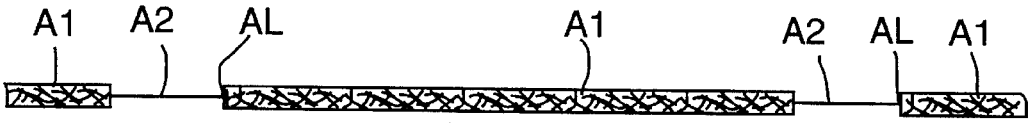
FIG. 5 is a side view of the towel material in FIG. 1.

FIGS. 1 to 12 show the embodiment. In the figure, denoted at B is a towel material of long size composed of pile fabric portions A1 and plain woven portions A2 alternately and continuously woven, the pile fabric portions A1 and plain woven portion A2 having given lengths respectively as illustrated in FIGS. 4 and 5.

Figure 1:
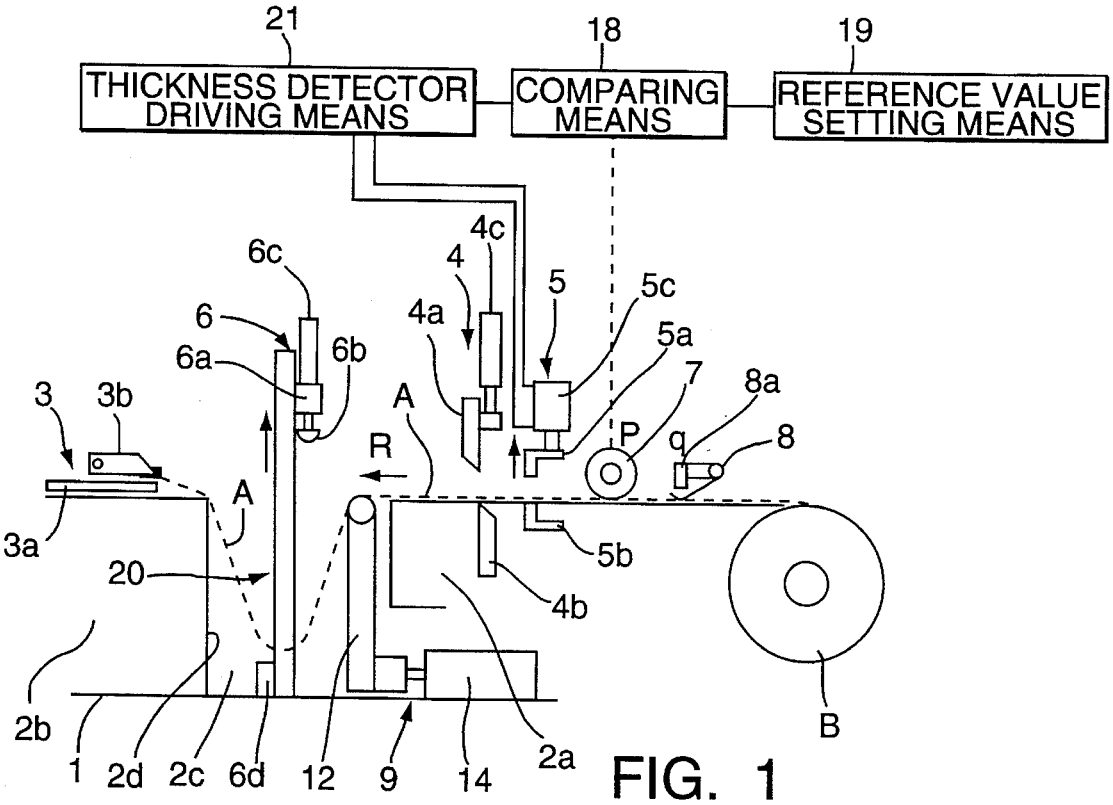
FIG. 1 is a view showing an arrangement of components of a towel cloth drawing-out device according to an embodiment of the present invention.

In FIGS. 1 and 2, denoted at 1 is an automatic towel sewing machine body, which comprises a first working table 2*a* and a second working table 2*b* facing each other with a gap 2*c* therebetween, the first and second working tables 2*a* and 2*b* being integrally formed with the towel automatic sewing machine body 1 and the second working table 2*b* having a vertical wall 2*d* on the side thereof. A towel cloth A which is drawn out from the towel material B is drawn out over the both working tables 2*a* and 2*b* in the direction of the arrow R.

Denoted at 3 is a clamping unit arranged on the second working table 2*b*, and the clamping unit 3 has a function of clamping the end portion, i.e., the plain woven portion A2 of the towel cloth A to draw out the same from the towel material B by a given length. That is, the clamping unit 3 which reciprocates on the second working table 2*b* by way of a driving unit, not shown, such as a cylinder unit etc. mounted on the second working table 2*b* clamps the edge of the plain woven portion A2 of the towel material B, from which the towel cloth A bas cut off by a cutting device 4, described later, by way of a clasp 3*b* provided at the tip end portion of a base plate 3*a* thereof to draw out the same to the position above the gap 2*c* between the first and second working tables 2*a* and 2*b* by a given length as it moves on the second working table 2*b* in the longitudinal direction of the towel cloth A (in the direction of the arrow R).

The cutting device 4 is provided on the first working table 2*a* across the same being disposed at right angles to the longitudinal direction of the towel cloth A and being spaced away by a given distance from a thickness detector 5, described later, in the drawing direction of the towel cloth A. The given distance is half as long as the length of the plain woven portion A2 illustrated in FIGS. 4 and 5. The cutting device 4 cuts the towel cloth A at the central portion of the plain woven portion A2 thereof between a movable knife 4*a* and a fixed knife 4*b* by actuating a cylinder unit 4*c* fixed to the automatic towel sewing machine body 1 to move the movable knife 4*a* toward the fixed knife 4*b*. The cylinder unit 4*c* is connected to a compressed air source 15 by way of a changeover valve similar to a changeover valve 16, described later.

Denoted at 5 is a thickness detector provided on the first working table 2*a* disposed at the side of the towel material B relative to the cutting device 4 and the thickness detector 5 equipped with an upper block 5*a* and a lower block 5*b* arranged along a straight line perpendicular to the longitudinal direction of the towel cloth A fed in the direction of the arrow R lowers the upper block 5*a* onto the towel cloth A by operating forward the cylinder unit fixed to the automatic towel sewing machine body 1 to form a stop slit t between the upper and lower blocks 5*a* and 5*b*, the stop slit t passing the plain woven portion A2 but preventing the pile fabric portions A1 from passing therethrough as illustrated in FIG. 3. That is, the stepped portion formed on the line of demarcation AL between the plain woven portion A2 and pile fabric portions A1 is retained at the leading edge of the latter by the stop slit t formed between the upper block 5*a* and lower block 5*b* so as to stop drawing the towel cloth A from the towel material B in such a way as to correct the deviation from the straight line of demarcation AL.

Denoted at 6 is a towel cloth drawing unit provided across the longitudinal direction of the towel cloth A in the gap 2*c* between the first and second working tables 2*a* and 2*b*. The towel cloth drawing unit 6 draws out a towel cloth A of a given length (substantially as long as a piece of towel) from a towel material B clamped by the clasp 3*b* of the clamping unit 3 at one end portion thereof by lowering a pushing down member 6*a* in the gap 2*c* between the first and second working tables 2*a* and 2*b* by way of a drawing drive unit 20 fixed to the automatic towel sewing machine body 1. The drawing drive unit 20 is equipped with a timing belt 6*e* driven by a pulse motor 6*d* in a normal or reverse direction, and the pushing down member 6*a* is fixed to the timing belt 6*e*. A microcomputer 50 serving as a control unit controls the revolution of the pulse motor 6*d*.

A plurality of towel cloth pads 6*b* are arranged at regular intervals under the pushing down member 6*a*, each towel cloth pad 6*b* being individually fixed to a pneumatic cylinder 6*c* fixedly mounted on the pushing down member 6*a*. Each pneumatic cylinder 6*c* is connected to the compressed air source 15 by way of a changeover valve, not shown. Each pneumatic cylinder 6*c* operates to individually lower each towel cloth pad 6*b* so as to further draw the towel cloth A which has been drawn out by the pushing down member 6*a* until the towel cloth A is stopped by the stop slit t of the thickness detector 5 for positioning the towel cloth A as described above.

Thus, the pushing down member 6*a* and towel cloth pads 6*b* lower in one body in the gap 2*c* between the first and second working tables 2*a* and 2*c* for intermittently drawing out the towel cloth A further by a given length from the towel material B from which the towel cloth A has been drawn out by a given length by way of the clamping unit 3, then the towel cloth pads 6*b* are individually lowered relative to the pushing down member 6*a* to further draw out the towel cloth A by a given short length.

Denoted at 7 is a rotary encoder serving as a feeding length detection means, which is provided on the first working table 2*a* at the side of the towel material B relative to the thickness detector 5 and is swingably supported by a supporting shaft 7*a* fixed to the automatic towel sewing machine body 1. The rotary encoder 7 always contacts on the surface of the towel cloth A which has been drawn out on the first working table 2*a* with a given friction and is driven to rotate by the feeding of the towel cloth A in synchronism therewith. The rotary encoder 7 measures the length P of the towel cloth A which is drawn out by the towel cloth pads 6*b* of the towel cloth drawing unit 6, more concretely by the operation of each pneumatic cylinder 6*c* after the thickness detector 5 forms the stop slit t with the plain woven portion A2 of the towel cloth A therein. When the measured length P is not within a preset range, i.e., the positioning of the towel cloth A is not in order, the microcomputer decides that the length of the towel cloth A is abnormal and issues a control signal to operate a towel cloth clamp unit 9, described later.

That is, the thickness detector 5 is operated to from the stop slit t with the plain woven portion A2 of the towel cloth A therebetween after the clamping unit 3 and pushing down members 6*a* have drawn out the towel cloth A substantially as long as a piece of towel onto the first and second working tables 2*a* and 2*b*. At the same time the rotary encoder 7 starts measuring. Then a plurality of towel cloth pads 6*b* of the towel cloth drawing unit 6 arranged across the towel cloth A individually lower until the stepped portion on the line of demarcation AL is aligned in a straight line and stopped by the stop slit t at the leading edge of the pile fabric portions A1 so that the towel cloth A is drawn out accurately as long as a piece of towel as illustrated in FIG. 3. Whereas the rotary encoder 7 measures the length of the towel cloth A which is drawn out as the towel cloth pads 6*b* of the towel cloth drawing unit 6 lower and produces a detected value p. The detected value p is input to the microcomputer 50. The detected value p is almost constant since the length of the towel cloth A which is drawn out by the clamping unit 3 and that drawn out by the pushing down members 6*a* of the towel cloth drawing unit 6 are both almost constant.

The microcomputer 50 constitutes a comparing means 18 and a reference value setting means 19 as illustrated in FIG. 1. A reference value U corresponding to the towel cloth A is stored in the reference value setting means 19 in advance. The comparing means 18 compares the detected value p with the reference value U to decide as to whether or not the detected value p is within a given error range ±σ relative to the preset reference value U, and in case it is not, operates a thickness detector driving means 21 to operate the cylinder unit 5c of the thickness detector 5 backward. As a result, the stop slit t is opened to allow the pile fabric portions A1 to pass therethrough. Hereupon, the detected value p deviates from the given error range of ±σ relative to the preset reference value U, for example, in case the plain woven portion A2 or pile fabric portion A1 is abnormal in length due to a towel material B having a weave error or joints therein.

The thickness detector driving means 21 is concretely composed of an changeover valve 16 illustrated in FIG. 2. Compressed air is supplied to the lower chamber of the cylinder unit 5c from the compressed air source 15 and the upper chamber is exhausted for raising the upper block 5a to open the stop slit t by switching the changeover valve 16 to an a position, while the compressed air is supplied to the upper chamber of the cylinder unit 5c from the compressed air source 15 and the lower chamber of the cylinder unit 5c is exhausted for lowering the upper block 5a to form the stop slit t by switching the changeover valve 16 to a b position.

Denoted at 8 is a pile fabric portion detector, which is provided on the first working table 2a at the side of the towel material B relative to the thickness detector 5 and is fixed to the automatic towel sewing machine body 1 by way of the supporting shaft 7a. The pile fabric portion detector 8 operates in drawing out next towel cloth A in case the detected value p set forth above deviates from the given error range of ±σ relative to the preset reference value U, i.e., the plain woven portion A2 or pile fabric portions A1 is abnormal in length. That is, the pile fabric portion detector 8 detects the line of demarcation AL between the plain woven portion A2 and pile fabric portions A1 A1 the towel cloth A which is drawn out onto the first working table 2a by way of a sensor 8a therein, supplies a detection signal q to the microcomputer 50 and operates the thickness detector 5 to form the stop slit t in response to a signal supplied by the microcomputer 50.

Denoted at 9 is a towel cloth clamp unit provided in the gap 2c. The towel cloth clamp unit 9 is composed of a pair of clamp member guide bases 11 which are movable in the longitudinal direction (the direction of the arrow R) of the towel cloth A, each clamp member guide base 11 being guided by each of a pair of parallel guide rails 10 fixed to the automatic towel sewing machine body 1 under the gap 2c, a towel cloth clamp member 12, which is fixed to the pair of clamp member guide bases 11 at the lower end portion 12a thereof and contacts the lower surface of the towel cloth A drawn out onto the gap 2c to hang therein at the upper end portion 12b thereof, and the driving unit 14 which is a reciprocal pneumatic cylinder unit provided in the lower portion of the gap 2c. Guide rollers 13 are rotatably attached to the upper end portion 12b of the towel cloth clamp member 12 disposed almost as high as the upper surfaces of the first and second working tables 2a and 2b to be in contact with the lower surface of the towel cloth A for preventing the same from being injured.

The towel cloth clamp member 12 connected to the tip end of the piston rod 14a of the driving unit 14 advances until it is brought in contact with the vertical wall 2d of the second working table 2b, the vertical wall 2d defining the gap 2c on one side thereof, and returns to the side of the first working table 2a by the operation of the driving unit 14 so as to reciprocate therebetween. The driving unit 14 is connected to the compressed air source 15 by way of a changeover valve, not shown, similar to the changeover valve 16. The towel cloth clamp unit 9 clamps the towel cloth A having an irregular length, which has been drawn out by the towel cloth drawing unit 6 and hangs in the gap 2c after the pushing down member 6a is raised, between the vertical wall 2d of the second working table 2b and itself.

The function of the above embodiment will be described with reference to FIGS. 6 to 12.

At first, a disorder in the length of the towel cloth A is detected. That is, the towel cloth A is drawn out substantially as long as a piece of towel onto the first and second working tables 2a and 2b by the clamping unit 3 and pushing down member 6a and the stop slit t is formed by the thickness detector 5. The rotary encoder 7 measures the length of the towel cloth A which is drawn out by the plurality of towel cloth pads 6b after the stop slit t is formed until the towel cloth A is retained and aligned by the stop slit t of the thickness detector 5 at the stepped portion thereof on the line of demarcation AL and the detected value p detected by the rotary encoder 7 is read (Step 1). Then the reference value U corresponding to the towel cloth A set by the reference value setting means 19 is read in Step 2.

Then in Step 3, the comparing means 18 compares the detected value p with the reference value U to decide as to whether there is abnormality or not in the detected value p. That is, abnormality is detected in case the upper block 5a of the thickness detector 5 lowers onto the pile fabric portions A1 or onto the plain woven portion A2 which is different in length from a regular one due to a towel material B having a weave error or joints therein so that the rotating angle of the rotary encoder 7 deviates from a preset range. Concretely, the comparing means 18 decides as to whether or not the detected value p deviates from a given error range ±σ relative to the preset reference value U, and in case it does, the detected value p is decided to be abnormal.

For example, in case the upper block 5a lowers onto a plain woven portion A2 which is longer than a standard length, the rotary encoder 7 rotates more than a given number of revolution to detect the generation of abnormality, while in case the upper block 5a lowers onto a plain woven portion A2 which is shorter than the standard length, the rotary encoder 7 rotates less than the given number of revolution to detect the generation of abnormality. Moreover, in case the upper block 5a lowers onto a pile fabric portions A1, the thickness detector 5 meets with resistance so that the towel cloth pads 6b are not operated and the rotary encoder 7 does not rotate so far as the preset angle to detect the generation of abnormality.

Figure 6:
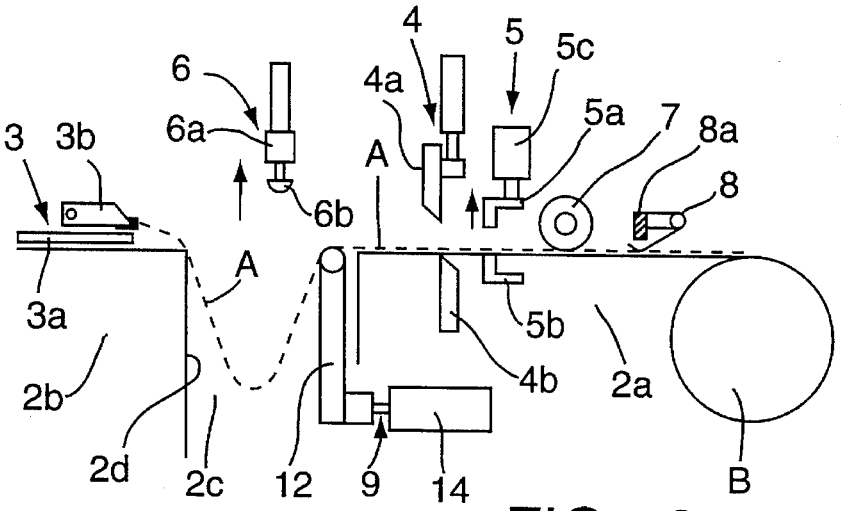
FIG. 6 is a view for explaining the operation of the towel cloth drawing-out device in FIG. 1.

In case the generation of abnormality is detected as described above, the process proceeds to Step 4, in which the thickness detector driving means 21 is operated to operate the cylinder unit 5c of the thickness detector 5 backward as illustrated in FIG. 6. As a result, the stop slit t is opened to allow the pile fabric portions A1 to pass therethrough. After opening the stop slit t, the process proceeds to Step 5, in which the pulse motor 6d is driven to rotate to raise the pushing down member 6a of the towel cloth drawing unit 6 to its standby position. A plurality of towel cloth pads 6b are also raised to their standby positions properly.

Figure 7:
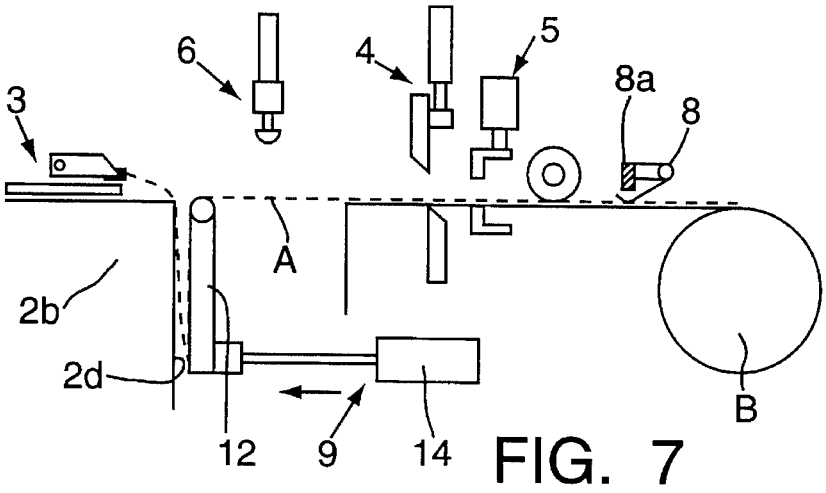
FIG. 7 is a view for explaining the operation of the towel cloth drawing-out device m FIG. 1.

Then in Step 6, the driving unit 14 of the towel cloth clamp unit 9 is operated forward to move the towel cloth clamp member 12 toward the vertical wall 2d so as to clamp the towel cloth A which hangs in the gap 2c between the vertical wall 2d of the second working table 2b and itself as illustrated in FIG. 7. In doing so, the towel cloth A is drawn out by a given length from the towel material B while the towel cloth A is clamped by the clamping unit 3 at the plain woven portion A2 thereof.

Figure 8:
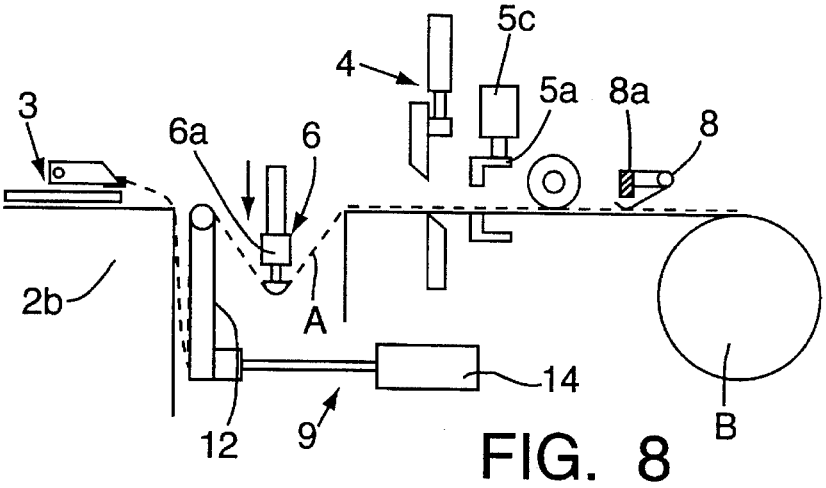
FIG. 8 is a view for explaining the operation of the towel cloth drawing-out device in FIG. 1.
Figure 9:
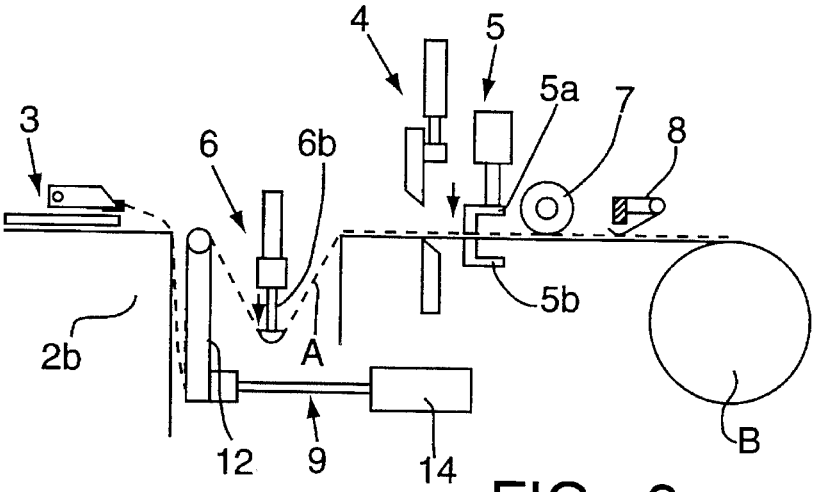
FIG. 9 is a view for explaining the operation of the towel cloth drawing-out device in FIG. 1.

In Step 7, the drawing drive unit 20 is operated again to lower the pushing down member 6*a* in the gap 2*c* for drawing out the towel cloth A substantially by a piece of towel from the towel material B as illustrated in FIG. 8. The sensor 8*a* of the pile fabric portion detector 8 detects the line of demarcation AL between the plain woven portion A2 and pile fabric portions A1 of the towel cloth A during the drawing operation of the towel cloth A. When the line of demarcation AL is detected, the process proceeds from Step 8 to Step 9, in which the thickness detector 5 operates to lower the upper block 5*a* onto the towel cloth A for forming the stop slit t and each towel cloth pad 6*b* of the towel cloth drawing unit 6 lowers to draw out the towel cloth A until the same is retained and stopped by the stop slit t on the line of demarcation AL at the leading edge of the pile fabric portions A1 thereof to be aligned in position as illustrated in FIG. 9 (Step 10).

Figure 10:
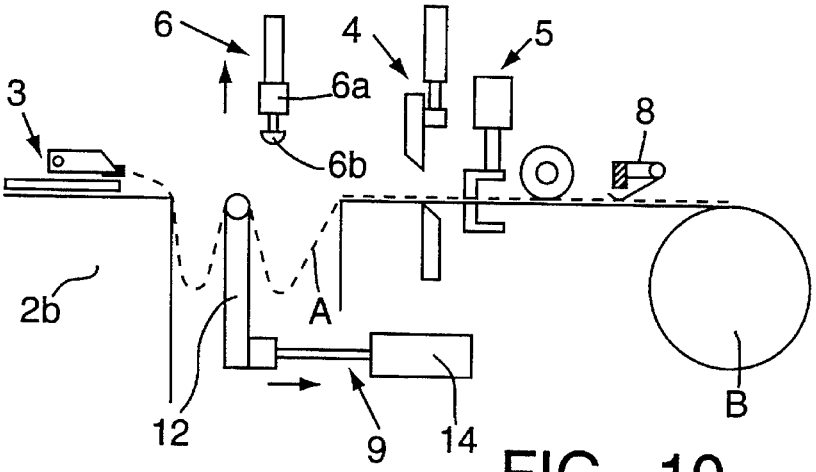
FIG. 10 is a view for explaining the operation of the towel cloth drawing-out device in FIG. 1.
Figure 11:
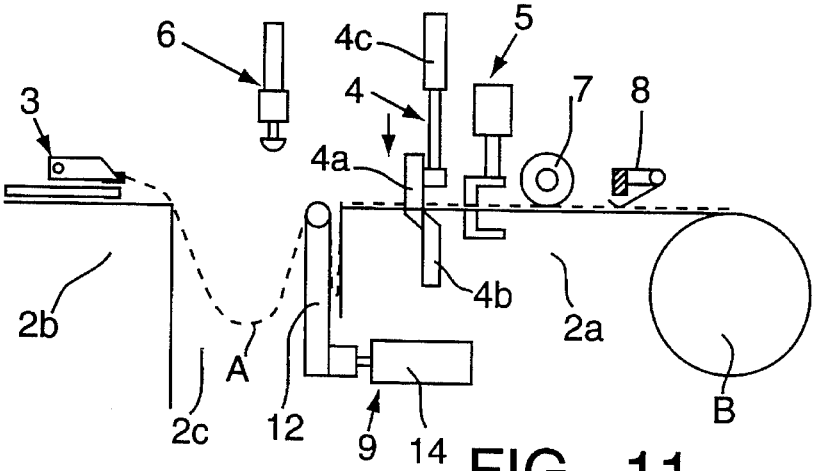
FIG. 11 is a view for explaining the operation of the towel cloth drawing-out device in FIG. 1.
Figure 12:
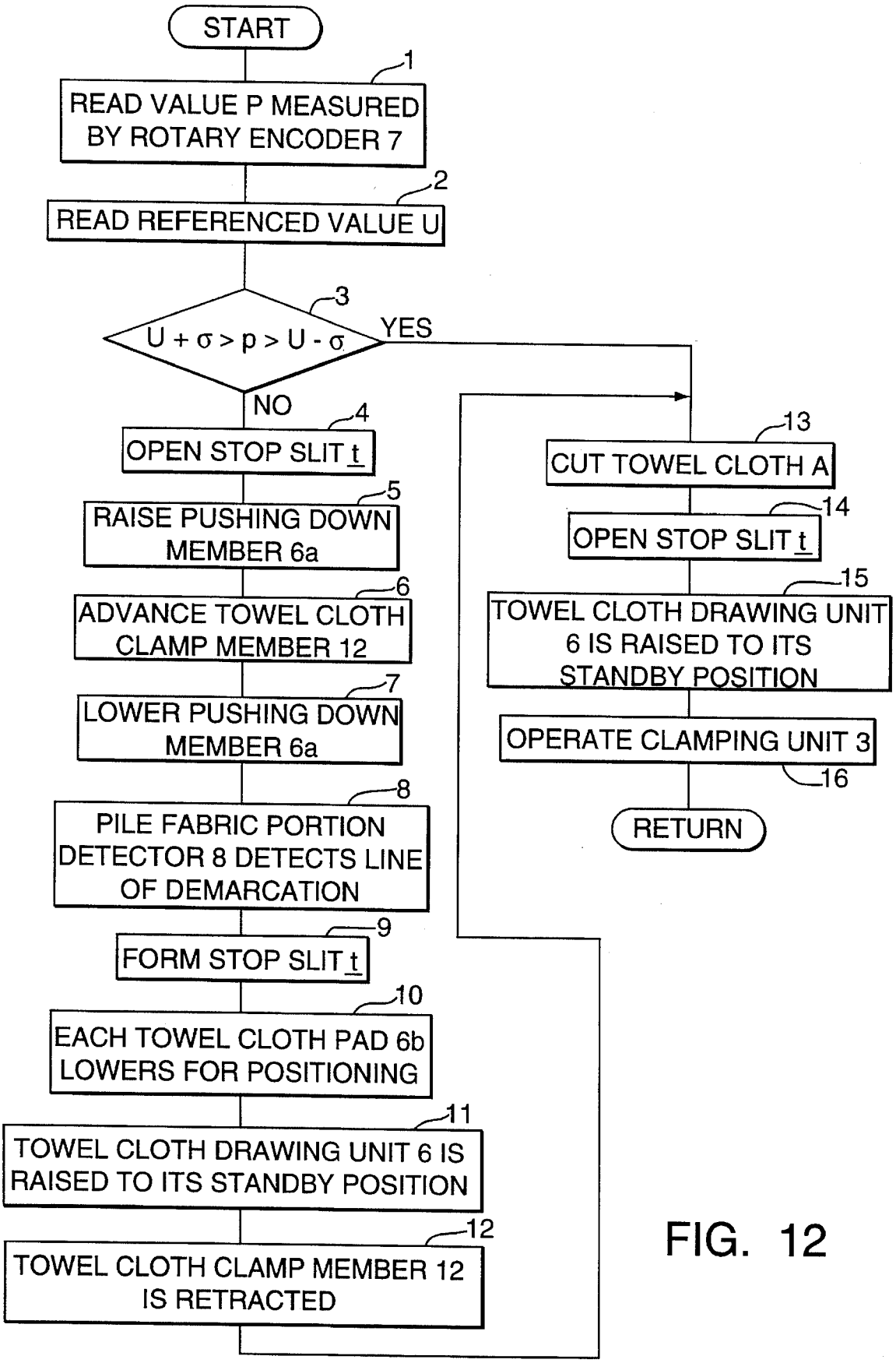
FIG. 12 is a view showing the flowchart of operation of the towel cloth drawing-out device in FIG. 1.

When the towel cloth A is aligned in position as described above, The pushing down member 6*a* and towel cloth pads 6*b* of the towel cloth drawing unit 6 are raised together to their standby positions as illustrated in FIG. 10 (Step 11) and at the same time the driving unit 14 of the towel cloth clamp unit 9 is operated backward to retract the towel cloth clamp member 12 toward the first working table 2*a* (Step 12) to release the towel cloth A from being clamped between the towel cloth clamp member 12 and the vertical wall 2*d*. Then the process proceeds to Step 13, in which the cutting device 4 cuts the towel cloth A at the central portion of the plain woven portion A2 thereof between the movable and fixed knives 4*a* and 4*b* as illustrated in FIG. 11. The towel cloth A which has been cut off from the towel material B and is substantially twice as long as a piece of towel smoothly falls in the gap 2*c* while being in contact with the guide rollers 13 of the towel cloth clamp member 12 when it is released from being clamped by the clamping unit 3.

On the other hand in case the towel cloth A has a standard length, the process proceeds from Step 3 to Step 13, in which the cutting device 4 cuts the towel cloth A at the central portion of the plain woven portion A2 thereof. The cutting device 4 is returned to its standby position after cutting, and the stop slit t is opened in the same way as in Step 4 (Step 14). When the stop slit t is opened, the pushing down member 6*a* and each towel cloth pad 6*b* of the towel cloth drawing unit 6 are raised to their standby positions in the same way as in Step 5 (Step 15). Then the process proceeds to Step 16, in which the clamping unit 3 clamps the plain woven portion A2 of the towel material B from which the towel cloth A has been cut off by the cutting device 4 to draw out the towel cloth A by a given length from the towel material B. As the clasp 3*b* of the clamping unit 3 operates, the towel cloth A which has been clamped thereby after it was cut off from the towel material B falls in the gap 2*c*.

A series of processes set forth above are successively repeated to cut the towel material B into a plurality of towel cloths A.

The towel cloths A which have been cut by the cutting device 4 and fell in the gap 2*c* are collected thereafter. Since the towel cloth A of almost twice as long as a piece of towel is cut off from the towel material B in case the plain woven portion A2 or pile fabric portions A1 is irregular in length due to a weave error, joint portions, etc. in the towel material B, the towel cloth A having the irregular length is removed from the sewing operation line.

As understood from the above description according to the present invention, since a long towel cloth can be drawn out from a towel material of long size alternately and continuously composed of pile fabric portions and plain woven portions in case the former is successively cut off as long as a piece of towel from the latter, it is possible to automatically continue the cutting operation of towel cloth by successively drawing out the towel material without substantially stopping the cutting operation even if the towel material has joint portions therein or a weave error in the length of the pile fabric portion or the plain woven portion thereof. As a result, it is possible to remarkably improve productivity and operability in a towel sewing factory.

What is claimed is:

1. A towel cloth drawing-out device for intermittently drawing out a towel cloth substantially as long as a piece of towel from a towel material of long size alternately and continuously composed of pile fabric portions and plain woven portions having a line of demarcation disposed therebetween, and thereafter aligning the line of demarcation between said pile fabric portion and said plain woven portions to cut said towel material at the plain woven portion thereof; characterized in that said towel cloth drawing-out device comprises a pair of working tables facing each other with a gap therebetween;

a cloth drawing unit for drawing out said towel cloth from said towel material to hang the same in said gap;

a towel cloth clamp member which is provided in said gap and is able to reciprocate in the drawing direction of said towel cloth;

a driving unit for reciprocating said towel cloth clamp member; and a vertical wall which is provided on the side of one of said working tables, said working table being disposed on the drawing side of said towel cloth, wherein the towel cloth is clamped between the vertical wall and the clamp member when the clamp member is reciprocated in the drawing direction by the driving unit.

* * * * *